United States Patent [19]

Floyd

[11] Patent Number: 4,995,307

[45] Date of Patent: Feb. 26, 1991

[54] VARIABLE AIR VOLUME VENTILATION SYSTEM AND METHOD

[76] Inventor: Bobby Floyd, 5N060 Medinah Rd., Addison, Ill. 60101

[21] Appl. No.: 405,762

[22] Filed: Sep. 11, 1989

[51] Int. Cl.[5] ..... F24F 7/08

[52] U.S. Cl. ..... 98/34.5; 98/1.5; 98/34.6

[58] Field of Search ..... 98/34.5, 31.5, 31.6, 98/34.6, 1.5; 165/16, 31; 137/12, 14, 100, 117, 486; 73/199; 48/191

[56] References Cited

U.S. PATENT DOCUMENTS

| | | | |
|---|---|---|---|
| Re. 28,946 | 8/1976 | Martz et al. | 98/34.5 |
| 3,402,654 | 9/1968 | Berst | 98/34.5 |
| 4,191,209 | 3/1980 | Mattson et al. | 137/486 |
| 4,392,417 | 7/1983 | Johannsen | 98/1.5 |
| 4,437,608 | 3/1984 | Smith | 236/49.3 |
| 4,485,729 | 12/1984 | Criffenden et al. | 98/1.5 |
| 4,643,353 | 2/1987 | Harris | 137/486 |
| 4,836,096 | 6/1989 | Avery | 98/34.5 |

FOREIGN PATENT DOCUMENTS

| | | | |
|---|---|---|---|
| 0589592 | 1/1978 | U.S.S.R. | 98/1.5 |

*Primary Examiner*—Henry A. Bennet
*Assistant Examiner*—W. C. Doerrler
*Attorney, Agent, or Firm*—Douglas B. White

[57] ABSTRACT

Generally there is provided for placement in the supply and return air ducts of a building ventilation system, a unique flow control unit having an orifice, static pressure sensors on opposite sides of the orifice, and sensor controlled dampers to regulate flow through the unit. In a further aspect, a remote static pressure sensor may be located at a strategic position in the ducts and arranged to control the dampers in the flow control units to alter the flow through the unit in response to system demand. In another aspect there is described a terminal box of similar design for controlling flow into and out of a room. This box provides center dampers on both supply and return ducts and pressure sensors on both sides of the center dampers. Under control of the room thermostat, both center dampers are adjusted under common control. The pressure sensors on either side of the center dampers are connected to control end dampers upstream and downstream of the unit in reponse to a chosen pressure differential.

11 Claims, 3 Drawing Sheets

VARIABLE AIR VOLUME VENTILATION SYSTEM AND METHOD

BACKGROUND OF THE INVENTION

1. Field of the Invention

This invention relates generally to the field of heating, ventilating and air conditioning systems; and relates more particularly to systems and methods for controlling the air flow and the relative pressures within a building.

2. Description of the Prior Art

Variable air volume systems have been widely accepted as the preferred system for building ventilation and typically utilize both a supply fan and return/exhaust fan to provide the ventilating air flow. Control of supply fan volume has been accomplished by using a static pressure sensor remotely located in the air supply system. This sensor is connected to provide control signals to either a vortex damper at the supply fan outlet, motor speed controls, or other means to regulate the supplied air flow, and in that manner the system operates to maintain a preset downstream pressure. Other versions have employed flow sensors to measure what is sometimes referred to as a velocity pressure. These have proved adequate for supply fan control but inadequate when it is desired to control and coordinate the return/exhaust with the supply.

An example of the first mentioned prior system is described in U.S. Pat. No. 4,437,608 wherein static pressure in the supply duct is used to control power to both the drive fan and to the return fan, and by that means it automatically adjusts to system demand. Similarly, in U.S. Pat. No. 4,407,185 a system is described in which the return fan is controlled in response to a static pressure measured at the supply. This technique is used to maintain a negative pressure at the inlet to the supply and thereby draw outside air into the system.

Other recent improvements have involved use of a wide dead band in conjunction with logical pressure sensor controllers to provide control to the inlet dampers (U.S. Pat. No. 4,392,417); while the basic variable volume system has been shown and described in U.S. Pat. No. 4,086,781. In that basic system, a supply duct damper is shown controlled by a pressure sensor located proximate thereto and arranged to maintain constant supply pressure.

Prior art systems, while able to measure static pressure, cannot efficiently control the return/exhaust and coordinate that flow with the supply. This resulting inefficiency is costly, not only in the discomfort caused, but in the higher energy requirements of the system. Moreover, when precise control is required within a building space, such as is often required for laboratory exhaust flow, no effective system has been presented. Lengthy discussions of these problems are provided in the cited prior art.

SUMMARY OF THE INVENTION

It is accordingly a principal objective of the present invention to provide an improved variable air ventilation system which yields greater accuracy and energy efficiency.

It is a further object to provide such a variable air volume system which accurately measures and controls flow at predetermined locations in the ducts and is capable of establishing not only flow control but also pressure differential control in ductwork which controls building pressure through controlled air flow.

Generally there is provided a unique flow control unit having variable and/or fixed orifices therein, static pressure sensors on opposite sides of the orifice, and a damper associated with said unit controlled by the differential between the sensors. Such a unit may be set for a predetermined pressure differential across the orifice and therefore regulate flow. In a further aspect, a static pressure sensor or any other air priority control device may be located anywhere in the supply duct (except at the terminal end where static pressure may be too low to provide a usable signal), and arranged to control a variable orifice or damper in the flow control units to alter the flow volume throughout the unit in response to system demand.

In yet another aspect there is described herein a terminal box of design similar to the flow control unit for controlling flow into and out of an individual room or building space. This box provides commonly controlled center dampers on both supply and return ducts and pressure sensors on opposite sides of the center dampers; the center dampers being controlled by the room thermostat or other air priority controller. The pressure sensors on either side of the center dampers are connected to controllers to provide differential control of an end damper upstream of the center damper for the supply duct and downstream of the return duct center damper. As with the first mentioned flow control unit, the center damper responds to room demand and the end dampers operate to maintain preset pressure differentials across the center dampers.

While the invention will be described in connection with preferred embodiments, it will be understood that I do not intend to limit the invention to those embodiments. On the contrary, I intend to cover all alternatives, modifications, and equivalents as may be included within the spirit and scope of the invention as defined by the appended claims.

DESCRIPTION OF THE PREFERRED EMBODIMENT

Figure 1:
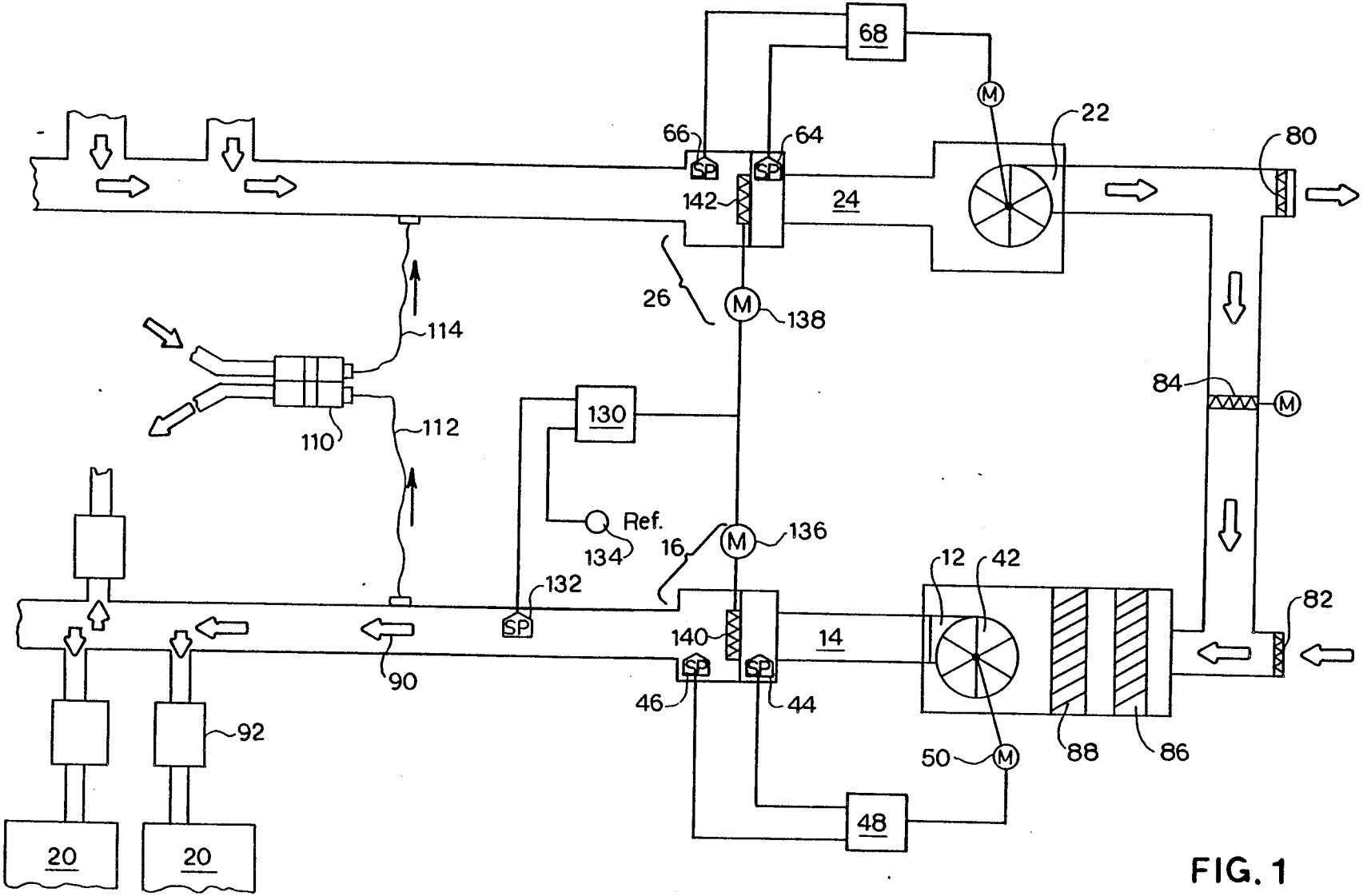
FIG. 1 is a schematic view of a ventilation system in accordance with the present invention showing the interconnection between the pressure sensors, controllers and the dampers.

Turning first to FIG. 1 there is shown a schematic of a version of the preferred embodiment of the invention. A supply fan 12 provides ventilating flow to a supply duct 14 and to a building space 20 via a flow control unit 16. Similarly, a return fan 22 draws flow through the return duct 24 from the building space 20 via a flow control unit 26.

Figure 2:
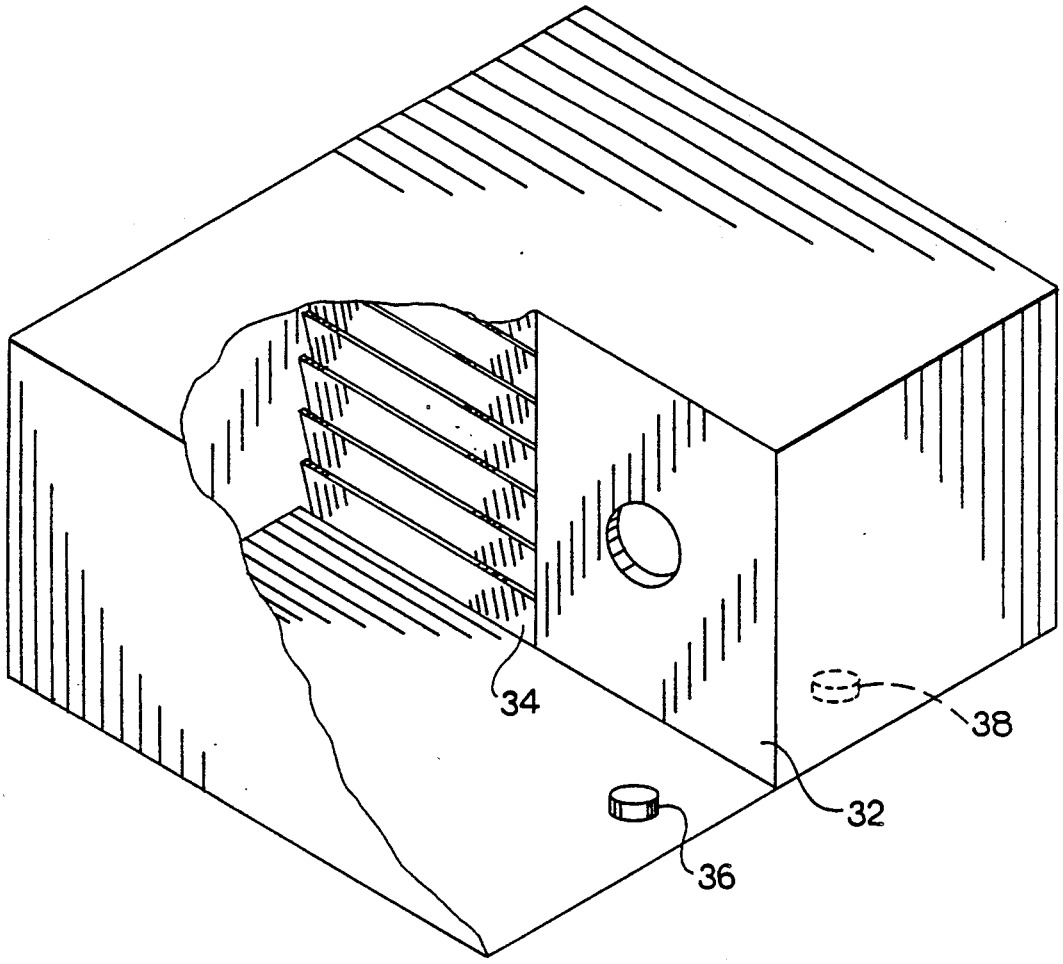
FIG. 2 is a perspective cut away view of a portion of the flow control unit of the present invention showing the relative positioning of the center dampers, orifices and pressure sensors.

The basic flow control unit (FIG. 2) as depicted on the supply and return ducts includes a partition in the duct having an orifice plate 32 and/or a damper 34, and further includes static pressure sensors 36 and 38 on opposite sides of the partition. These sensors detect static pressure on the upstream and downstream sides of the partition and provide signals representative of the detected pressure. Given a pressure differential across the partition with a given opening in the partition, a determinable flow is obtained.

In the embodiment shown in FIG. 1 the flow control unit on the supply duct functions with an associated damper 42. The damper shown in this embodiment is the supply fan vortex damper upstream of the flow control unit and it is arranged to be regulated by the differential in pressures sensed by the static pressure sensors 44 and 46 of the supply duct flow control unit. A differential controller 48, of a type well known in the industry, is arranged to receive the pressure sensor signals at its input and provide at its output a responsive control signal to the damper motor 50. These control signals may be either pneumatic, electrical, system powered or other means well known in the industry, depending on the control system choice of the designer. By setting the controller to respond to deviations from a predetermined differential, the supply damper will be automatically adjusted to maintain that desired pressure differential and a determinable flow will be obtained across the partition for a given opening in the partition.

In a similar fashion, the flow control unit in the return duct is arranged to control return flow. Static pressure sensors 64 and 66 provide pressure representative signals to the differential controller 68. As in the supply unit, this controller is set to respond to deviations in pressure differential and provide a control signal to the vortex damper on the return fan responsive to deviations from the desired pressure differential.

With this arrangement, precise flow for a given demand is obtainable in both the supply duct and the return duct. In accordance with accepted practice exhaust to the outside is controllable with exhaust damper 80 and flow of fresh outside air into the system is provided through fresh air damper 82. Recirculation damper 84 provides control over recirculated air; and heating element 86 and cooling coil 88 are used to regulate the supply air temperature.

In an alternative embodiment of the flow control unit portion of the invention, a downstream damper on the supply unit and an upstream damper on the return unit may also be included. In such an embodiment the pressure sensors of each unit would be connected to provide signals to differential controllers; but the controllers, in this instance, would be set to respond relative to a reference pressure outside of the ductwork, and the controller output would direct a signal proportional to the measured pressure differential to the associated damper. An upstream damper is set to be controlled by the upstream sensor and the downstream damper is set to be controlled by the downstream sensor. In this configuration the dampers would function to produce a preset pressure at the sensors connected thereto and thereby provide a determinable flow across the center damper/orifice.

Figure 3:
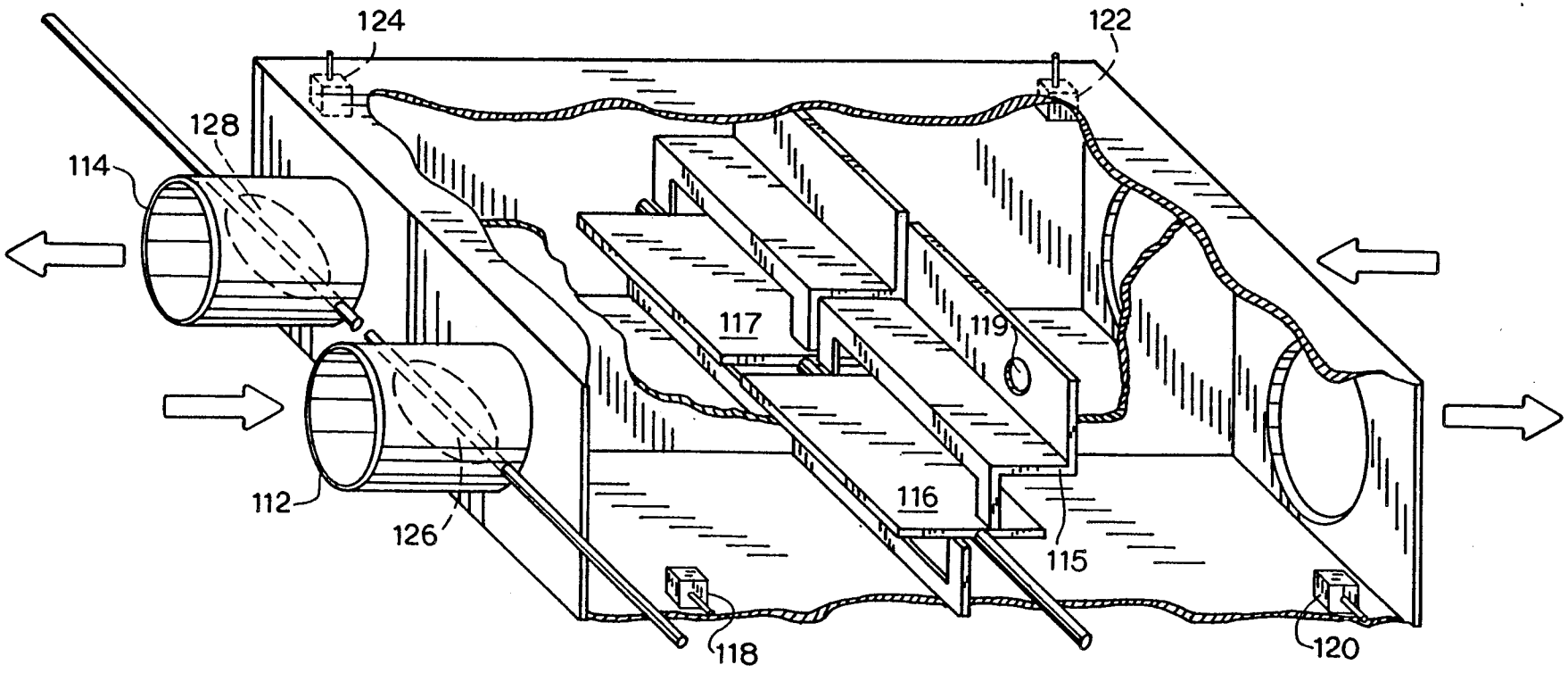
FIG. 3 is a perspective cut away view of a terminal box of the present invention, showing one version of the commonly controlled center dampers.

Turning now to the control of the flow 90 directed into the individual building space 20, this control is regulated via a terminal box 92 (FIG. 3). This box may, in one version, be of any commonly known construction employing simply a thermostat controlled damper on the supply duct. However, in a further feature of the present invention there is shown in FIG. 3 the combined supply/return terminal box 110. This terminal box is positioned to connect to the supply 14 and return 24 ducts via rigid or flexible conduits 112 and 114.

Within the terminal box there is provided a center partition 115 arranged to carry center dampers positioned in both supply and return ducts. The center dampers 116 and 117 are commonly controlled by a motor responsive to the room thermostat or any other manual or automatic control device. In a further version, a fixed orifice 119 may also be included as a parallel undamped path for supply flow (and similarly for return flow). Pressure sensors upstream 118 and downstream 120 of the center supply duct damper provide signals representative of the pressure sensed on opposite sides of the supply duct partition. Similarly in the return duct, pressure sensors upstream 122 and downstream 124 provide signals representative of the pressures sensed on opposite sides of the return duct partition.

In a further feature of the preferred embodiment of the terminal box 110 there is further provided on the supply duct an upstream end damper 126 and on the return duct a downstream end damper 128. As before, a differential controller is connected to receive signals from the sensors and to provide a control signal responsive to the differential between the sensed pressures to the end damper controlling motors.

In operation, as system demand is increased the center damper is opened under control of the thermostat or other automatic or manual control device. These controls may be pressure sensor responsive controllers, velocity or flow sensor actuated controllers, or any other controllers known in the art. With the opening of the center damper, the supply duct end damper opens to maintain the requisite pressure differential across the partition. Also responding to the flow, the return duct end damper regulates the flow to establish the preset desired pressure differential in the return duct. By setting the pressure sensors to a predetermined differential, control of the center damper precisely controls flow; and more importantly the desired supply flow and the desired exhaust/return flow is achieved.

In a further aspect, since flow is controllable by the setting of the pressure sensitive differential controllers, the controllers may be set to provide any desired flow in the supply and independently to provide any desired flow in the exhaust. Consequently, any selected exhaust flow may be maintained in laboratories by the presetting of the controllers; and particularly an exhaust flow equal to or greater than the supply flow may be maintained. This is important where exhaust hoods are used and noxious gasses must be controlled and exhausted from the building.

In a further feature of the ventilation system there is provided a remote controller 130 connected to a static pressure sensor 132 located in the supply duct. The controller is set to respond to the difference between the sensed pressure and a reference pressure 134 and to provide a controlling signal representative thereof. The controller signal is connected to damper controlling motors 136 and 138 to control the supply and return flow control unit dampers 140 and 142. This controller therefore operates to provide control signals to alter the size of the effective orifice in the supply and return flow control units in response to system demand.

A theoretical example of the operation of this system is as follows. The supply duct flow control unit controller 48 is set at a ½" pressure differential, and the return duct flow control unit controller 68 is also set at a ½" pressure differential. The remote controller is set at a 3" pressure differential between the sensor and atmosphere. When the supply and exhaust fans are started, the flow control unit dampers are opened and the vortex dampers at the supply and return fans open to raise the pressure in the system toward the remote controller's set point of 3". As that set point is reached, the remote controller starts closing both flow control unit dampers simultaneously. As this adjustment is accomplished, the supply flow control unit controller adjusts the supply vortex damper to maintain its preset pressure differential. Similarly, the return flow control unit controller adjusts the return vortex damper to maintain its preset differential. In this manner the system achieves, efficiently and without noticeable oscillation, the required flow for a desired system demand. When system demand increases or decreases, the dampers will automatically adjust to accommodate the flow and maintain the preset pressure differentials.

From the foregoing description, it will be apparent that the apparatus and method of the present invention may be applied to many other uses where this type of control is useful. As an example it may be used to control make-up air to kitchen hoods, to track variable air volume associated with solar panels, control air for heat exchangers, to control boiler combustion air, to control air within inflatable green houses, and to control the air mix in ventilation systems. It is therefore apparent that modifications can be made to the apparatus and method for using same without departing from the teachings of the present invention. Accordingly, the scope of the invention is only to be limited as necessitated by the accompanying claims.

I claim:

1. In a ventilation system for a building having a supply duct to a building space, a return duct from a building space, a supply fan and a return fan, the improvement comprising:

a first flow control unit positioned within the supply duct and a second flow control unit positioned within the return duct, said flow control units including an orifice, a first static pressure sensor positioned upstream of said orifice and a second static pressure sensor positioned downstream of said orifice to provide signals responsive to the sensed pressure on the opposite sides of said orifice, and a controller for providing an output responsive to the differential in the said sensed pressure;

first damper means positioned in said supply duct and operably connected to said controller of said first control unit to provide control of air flow therethrough in response to said sensed pressure differential in said first flow control unit;

second damper means positioned in said return duct and operably connected to said controller of said second flow control unit to provide control of air flow therethrough in response to said sensed pressure differential in said second control unit;

a remote static pressure sensor positioned downstream of said first flow control unit for providing an output signal responsive to the sensed pressure at said remote location;

a remote controller for providing a signal responsive to the difference between said sensed static pressure and a reference pressure; and first and second motor controlled dampers positioned within said first and second flow control units respectively and operably connected to said controller to respond to said controller output signal to vary the damper openings in said flow control units in the respective supply and return ducts in response to said remote controller.

2. The ventilation system of a building of claim 1 wherein said first damper means is positioned upstream of said first flow control unit and said second damper means is positioned downstream of said second flow control unit.

3. The ventilation system of a building of claim 2 wherein said first damper means comprises a motor controlled vortex damper at the supply fan and said second damper means comprises a motor controlled vortex damper at said return fan.

4. In a ventilation system for a building having a supply duct to a building space, a return duct from a building space, a supply fan and a return fan, the improvement comprising:

a first flow control unit positioned within the supply duct and a second flow control unit positioned within the return duct, said flow control units including an orifice, a first static pressure sensor positioned upstream of said orifice and a second static pressure sensor positioned downstream of said orifice to provide signals responsive to the sensed pressure on the opposite sides of said orifice, and a controller for providing an output responsive to the differential in the said sensed pressure;

first damper means positioned in said supply duct and operably connected to said controller of said first control unit to provide control of air flow therethrough in response to said sensed pressure differential in said first flow control unit;

second damper means positioned in said return duct and operably connected to said controller of said second flow control unit to provide control of air flow therethrough in response to said sensed pressure differential in said second control unit;

a terminal box proximate the building space for regulating supply and return air flow, said terminal box comprising:

control means for providing a control signal responsive to ventilation demand;

controllable center dampers in said supply duct and in said return duct arranged to be commonly controlled in response to said control means;

upstream and downstream pressure sensors in said supply duct positioned on opposite sides of said supply center damper to provide signals responsive to said sensed pressure;

upstream and downstream pressure sensors in said return duct positioned on opposite sides of said return center damper to provide signals responsive to said sensed pressures;

a supply controller connected to said supply duct pressure sensors for providing a signal responsive to the differential in the sensed pressures;

a return controller connected to said return duct pressure sensors for providing a signal responsive to the differential in the sensed pressures;

a supply damper operably connected to said supply controller for regulating the damper opening in response to said supply controller signal; and a return damper operably connected to said return controller for regulating the damper opening in response to said return controller signal.

5. The ventilation system for a building of claim 4 wherein said terminal box supply duct further comprises a fixed orifice for providing a path for the supply air flow parallel to said supply center damper.

6. The ventilation system for a building of claim 4 wherein said terminal box return duct further comprises a fixed orifice for providing a path for the return air flow parallel to said return center damper.

7. A method of controlling ventilation in a building having a supply duct to a building space, a return duct from a building space, a supply fan and a return fan, comprising the steps of:

(1) positioning flow control units within the supply duct and the return duct, said flow control units each comprising: an orifice, a first static pressure sensor positioned upstream of said orifice and a second static pressure sensor positioned downstream of said orifice, said sensors arranged to provide signals responsive to the sensed pressure on opposite sides of said orifice, and a controller connected to said pressure sensors for receiving said signals and providing an output responsive to the difference in said sensed pressures;

(2) positioning within said supply duct a first damper means, said first damper means being operably connected to said controller of said supply duct flow control unit to provide control of air flow therethrough in response to the sensed pressure differential across said supply duct flow control unit orifice;

(3) positioning within said return duct a second damper means, said second damper means being operably connected to said controller of said return duct to provide control of air flow therethrough in response to said sensed pressure differential across said return duct flow control unit orifice; and (4) setting said supply duct and return duct controllers to maintain predetermined pressure differentials across the respective flow control unit orifices;

(5) providing a remote static pressure sensor between said supply flow control unit and said return flow control unit for providing a signal responsive to the difference between the sensed pressure at said location and a reference pressure; and (6) providing a controllable damper within each of said supply and return flow control units operably connected to said remote sensor to regulate the damper opening in said flow control units.

8. The method of controlling ventilation in a building of claim 7 further comprising the step of providing a terminal box proximate the building space to regulate supply and return air flow, said terminal box comprising:

control means for providing a control signal responsive to ventilation demand;

controllable center dampers in said supply duct and return duct arranged to be commonly controlled in response to said control means;

upstream and downstream pressure sensors in said supply duct positioned on opposite sides of said supply center damper to provide signals responsive to said sensed pressure;

upstream and downstream pressure sensors in said return duct positioned on opposite sides of said return center damper to provide signals responsive to said sensed pressures;

a supply controller connected to said supply duct pressure sensors for providing a signal responsive to the differential in the sensed pressures;

a return controller connected to said return duct pressure sensors for providing a signal responsive to the differential in the sensed pressures;

a supply damper operably connected to said supply controller for regulating air flow in response to said supply controller signal; and a return damper operably connected to said return controller for regulating air flow in response to said return controller signal.

9. A control apparatus for regulating supply and return air flow comprising:

control means for providing a control signal responsive to ventilation demand;

controllable center dampers in said supply duct and in said return duct arranged to be commonly controlled in response to said control means;

upstream and downstream pressure sensors in said supply duct positioned on opposite sides of said supply center damper to provide signals responsive to said sensed pressure;

upstream and downstream pressure sensors in said return duct positioned on opposite sides of said return center damper to provide signals responsive to said sensed pressures;

a supply controller connected to said supply duct pressure sensors or providing a signal responsive to the differential in the sensed pressures;

a return controller connected to said return duct pressure sensors for providing a signal responsive to the differential in the sensed pressures;

a supply damper operably connected to said supply controller for regulating air flow in response to said supply controller signal; and a return damper operably connected to said return controller for regulating air flow in response to said return controller signal.

10. The control apparatus for regulating supply and return air flow of claim 9 further comprising a fixed orifice in said supply duct for providing a path for the air flow parallel to said supply center damper.

11. The control apparatus for regulating supply and return air flow of claim 9 further comprising a fixed orifice in said return duct for providing a path for the air flow parallel to said return center damper.

* * * * *